United States Patent [19]

Pyburn

[11] Patent Number: 4,528,925

[45] Date of Patent: Jul. 16, 1985

[54] UTILITY CONTAINER FOR CATAMARAN SAILBOATS

[76] Inventor: Robert M. Pyburn, 724 SE. Baker, Albany, Oreg. 97321

[21] Appl. No.: 568,901

[22] Filed: Jan. 4, 1984

[51] Int. Cl.[3] ..... B63B 17/00

[52] U.S. Cl. ..... 114/61; 114/343; 114/364

[58] Field of Search ..... 114/61, 363, 364, 343

[56] References Cited

U.S. PATENT DOCUMENTS

| | | | |
|---|---|---|---|
| 2,712,293 | 7/1955 | O'Higgins | 114/61 |
| 3,784,317 | 1/1974 | Currey | 114/61 |
| 3,958,289 | 5/1976 | Carlson | 114/364 |
| 4,108,100 | 8/1978 | Jamieson | 114/61 |
| 4,266,707 | 5/1981 | Rossman | 114/363 |
| 4,398,488 | 8/1983 | Mathieu | 114/363 |
| 4,428,617 | 1/1984 | Lawson | 114/363 |

FOREIGN PATENT DOCUMENTS

| | | | |
|---|---|---|---|
| 2291087 | 7/1976 | France | 114/61 |

OTHER PUBLICATIONS

Catamarans 1958, The Amateur Yacht Research Society, p. 44.

*Primary Examiner*—Sherman D. Basinger
*Assistant Examiner*—Thomas J. Brahan
*Attorney, Agent, or Firm*—Chernoff, Vilhauer, McClung, Birdwell & Stenzel

[57] ABSTRACT

A utility container for holding personal articles aboard a small catamaran sailboat, with separate internal compartments including an icebox compartment containing an icebox liner. The container is shaped to fit in a location near the front of the passenger-carrying area of the catamaran, occupying space otherwise including a front part of the trampoline. A transverse support member is located behind the container to support the front edge of the trampoline of the catamaran. A display area for instruments is included.

9 Claims, 6 Drawing Figures

UTILITY CONTAINER FOR CATAMARAN SAILBOATS

BACKGROUND OF THE INVENTION

The present invention relates to sailboats, and particularly to a container for use aboard small catamaran sailboats for holding personal articles such as spare clothing and refreshments.

Smaller sailboats of the twin hull, or catamaran, type are designed for "day sailing" and often lack any built-in storage compartments. Although built primarily for recreational sailing for relatively short times and distances, such small catamarans may nevertheless be sailed at times when the weather is changeable, or for periods of time long enough to make it desirable to take along food, extra clothing, or special sailing equipment whose usefulness depends upon particular conditions. Naturally, it is desirable to protect such articles from loss and, in the case of food and clothing, from becoming unnecessarily wetted by spray or rain. This has been unnecessarily difficult in the past aboard most small catamarans, of 16 feet and shorter length, for example, since such boats usually have only a platform of tightly stretched cloth (called a trampoline) to support people.

Such small catamaran sailboats are often used on lakes, where the water is often fairly calm, and it is frequently possible to relax and consume refreshments leisurely aboard the boat. Since there is no storage space provided on such small catamarans, refreshments, extra sailing equipment, or spare clothing carried aboard such a boat must be tied down, occupying space where it may interfere with sailing the boat. Such articles are, then, likely to obstruct people aboard the boat, be accidentally lost overboard, get wet, or simply take up space undesirably.

Some owners of sailboats find instrumentation such as a compass, a wind speed and direction indicator, and a water speed indicator desirable. However, in the popular commercially available catamarans not large enough to include solid cockpits or cabin structures there is ordinarily no space available for mounting the indicator dials of such instruments.

What is needed, therefore, is a utility container which can be added to a conventional small catamaran sailboat, and which includes protected storage space for personal articles of clothing, for equipment used to sail the boat, and for beverages or food for consumption aboard such a sailboat. Preferably such a utility container would also provide room for mounting display units of instruments useful in sailing such a catamaran and be strong enough to support the people aboard such a catamaran. Such a utility container must, of course, be securely attachable to a catamaran because of the normal wide range of motion and attitude of such a sailing craft.

Carlson U.S. Pat. No. 3,958,289 discloses a food storage compartment for use in a canoe. The storage compartment taught by Carlson, however, is not readily adaptable for use aboard a boat such as a sailing catamaran.

SUMMARY OF THE INVENTION

The present invention provides a utility container for use aboard small catamaran sailboats which lack cockpits or cabins having storage compartments. The utility container may be manufactured of glass-reinforced synthetic resin, using conventional methods, or of other suitably strong materials such as aluminum. It has a bottom section which extends transversely along the front portion of the passenger platform of a small catamaran sailboat. The container is preferably divided into three compartments by vertical dividers separating a deep center compartment from a shallower compartment located at each side. A front wall of the lower portion of the container slopes rearwardly and downwardly to help deflect spray and wind.

A top section of the container covers the bottom section, enclosing the storage compartments. The top section is arched upwardly, in a preferred embodiment, to correspond with the arch of a transverse frame member of one type of catamaran, simultaneously providing greater depth in the center compartment of the container.

An insulated ice chest is located in the center compartment of the utility container where it is preferably permanently attached. The center compartment is preferably provided with a drain extending from the ice chest through the bottom of the utility container.

A rearwardly and downwardly sloping area of the top section of the container, located rearward of the ice chest, is convenient for installation of display units of such instruments as a compass, a relative wind indicator and a water speed indicator.

Separate openings are provided in the top section of the container to provide access into each compartment, and a closable cover having a watertight seal is provided for each opening. The generally horizontal upper surfaces of the container and the compartment covers are preferably coated with a non-skid material so that a person can sit or stand on top of the container without danger of slipping.

It is therefore a principal objective of the present invention to provide a watertight storage container for protecting personal articles aboard a small catamaran sailboat.

It is another important objective of the present invention to provide a utility storage container having a plurality of separate compartments, including an insulated compartment for storage of chilled refreshments aboard a catamaran.

It is yet a further objective of the present invention to provide a convenient location for mounting of display dials for instruments such as a compass, wind speed indicator, and water speed indicator.

It is an important feature of the utility container of the present invention that it includes a thermally insulated storage compartment.

Another important feature of the present invention is that it provides a watertight container capable of providing additional reserve buoyancy for the catamaran on which it is used.

It is an important advantage of the present invention is that it provides a much better way to carry personal articles aboard a catamaran sailboat than has previously been available.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 4:
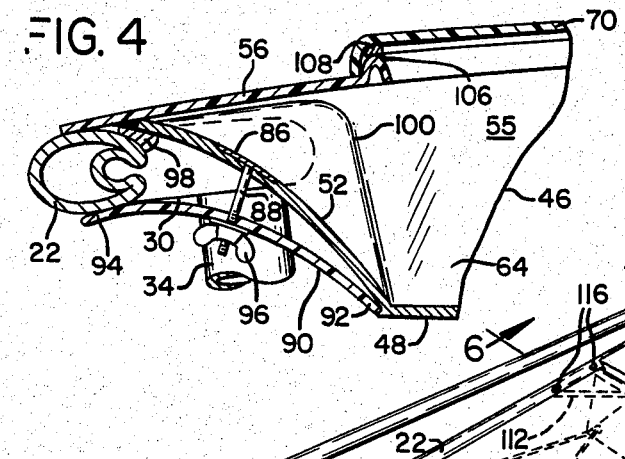
FIG. 4 is a sectional rear elevational view of the left end portion of the container shown in FIG. 2, taken along line 4—4.
Figure 1:
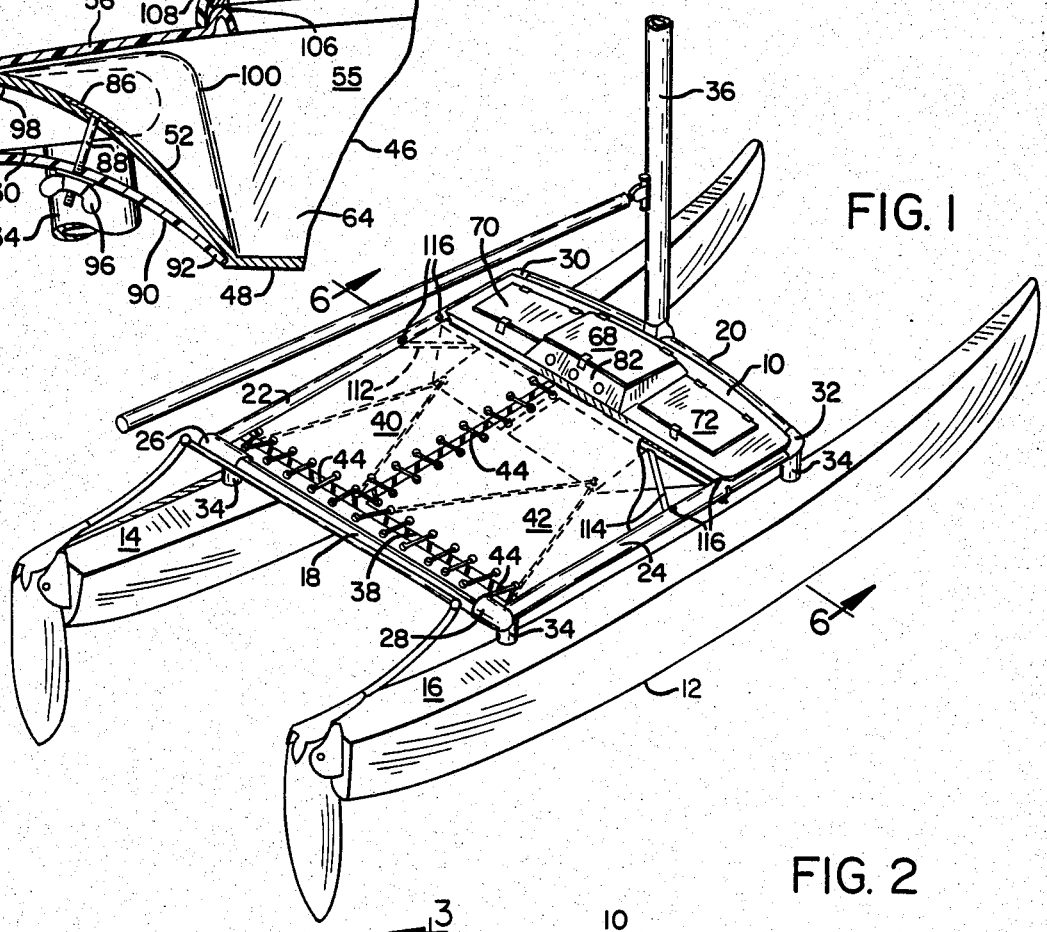
FIG. 1 is a perspective view of a small catamaran sailboat equipped with a utility container embodying the present invention.
Figure 2:
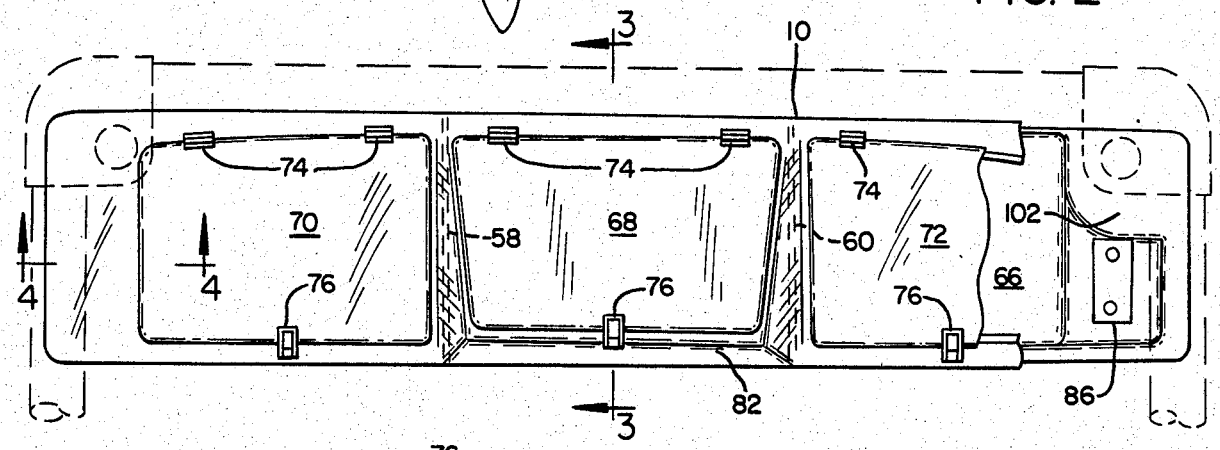
FIG. 2 is a top plan view of the utility container shown in FIG. 1, along with a portion of the catamaran shown in FIG. 1, at an enlarged scale.
Figure 3:
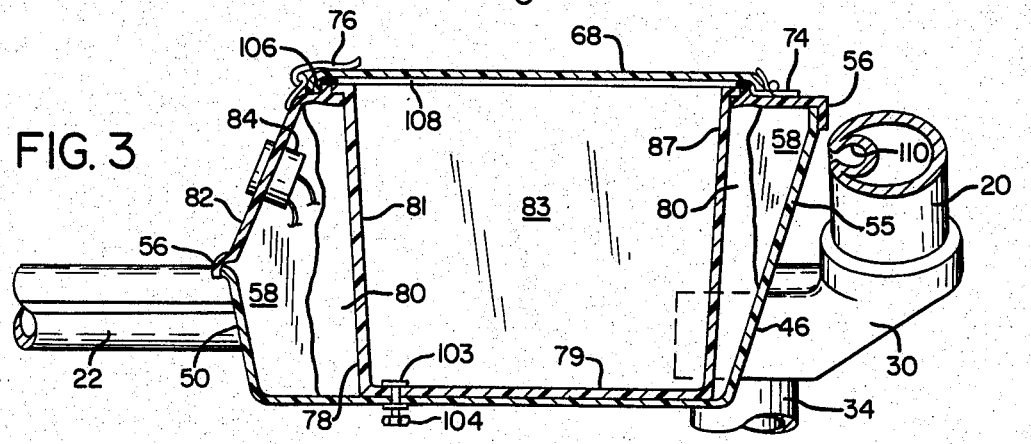
FIG. 3 is a sectional side view taken along the line 3—3 in FIG. 2.
Figure 5:
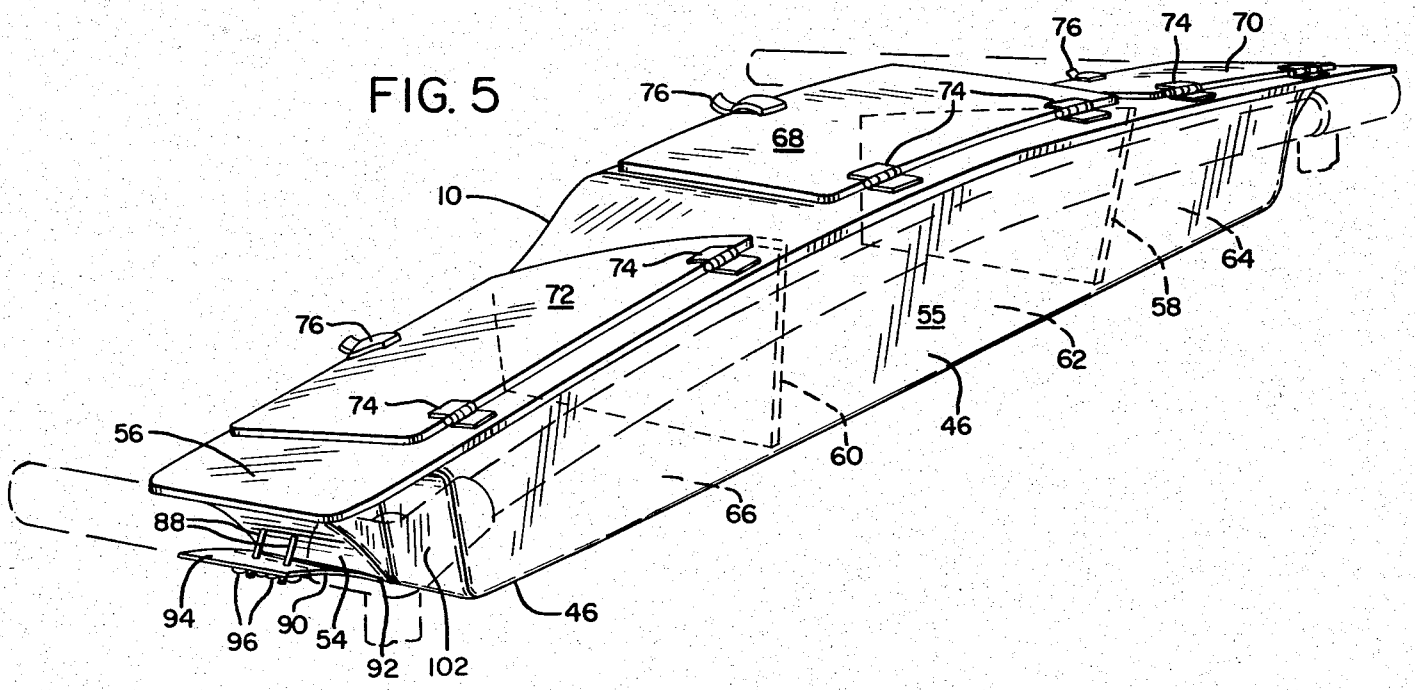
FIG. 5 is a perspective view of the container shown in FIG. 1, taken from the front upper right.
Figure 6:
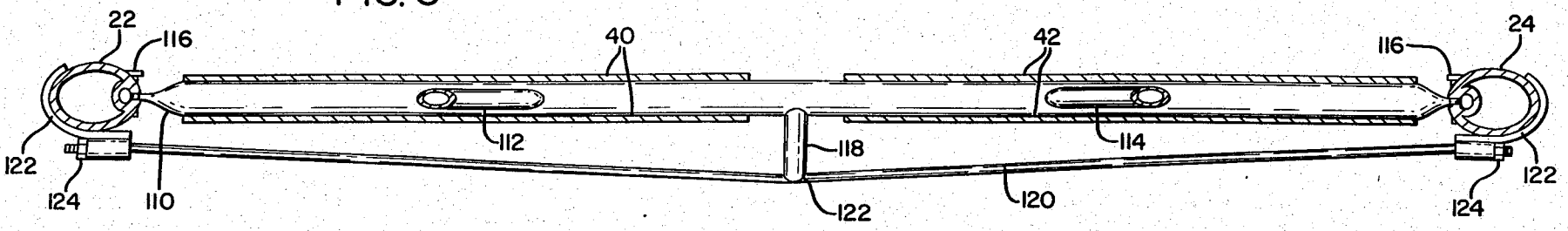
FIG. 6 is a rear elevational view of a portion of the catamaran shown in FIG. 1, taken along line 6—6, showing the structure supporting the front end of the trampoline of the catamaran when the utility container shown in FIG. 1 is in use.

Referring now to the drawings, a utility container 10 which is a preferred embodiment of the present invention is shown in FIG. 1 mounted on a catamaran sailboat 12. The catamaran sailboat 12 has a pair of elongate hulls 14 and 16 which extend parallel with one another and are held in this relationship with one another by a frame including a rear transverse frame member 18, a forward transverse frame member 20, and a pair of longitudinal frame members 22 and 24 which are fixedly connected with one another by respective corner pieces 26, 28, 30 and 32. Two of the corner pieces are connected to each of the hulls 14 and 16 by respective pylons 34 which extend vertically upward from the hulls. The forward transverse frame member 20 is curved in a low upwardly convex arch and supports a mast 36 which is stepped on the forward transverse frame member 20.

A cloth trampoline 38, including a left section 40 and a right section 42, is tightly stretched within the frame, with an outer longitudinal edge of each of the left and right portions 40 and 42 of the trampoline 38 being slideably engaged within a C-shaped slideway provided in the respective longitudinal frame member 22 or 24. Lacing 44 interconnects the right and left portions 40 and 42 with one another and permits the trampoline 38 to be tightened as necessary to provide support for people aboard the catamaran. Similarly, lacing 44 connects the rear edges of the left and right trampoline sections 40 and 42 with the rear transverse frame member 18.

Referring now also to FIGS. 2–5, the utility container 10 is made of glass fiber-reinforced resin construction in the conventional manner, preferably being laid up in layers of glass fiber cloth impregnated with resin. A bottom section 46 includes a bottom wall 48, a rear wall 50, a left end wall 52, and a right end wall 54 and a front wall 55. A top section 56 is fastened to the bottom section 46 by an adhesive resin, thereby forming a watertight seal between the bottom section 46 and the top section 56.

Preferably, a pair of vertical longitudinal dividers 58 and 60 are provided within the container 10, dividing it into three side-by-side watertight compartments, a center compartment 62 and a pair of outboard compartments, a left compartment 64, and a right compartment 66. The top section 56 defines an opening into each of the compartments 62, 64, and 66, with respective covers 68, 70, and 72 being provided as watertight closures for each of the compartments 62, 64, and 66. Each of the covers 68, 70, and 72 is attached to the top section 56 by hinges 74 and may be held closed by a releasable latch 76. As a safety precaution, the hinges 74 and latches 76 are of a somewhat flexible resilient synthetic plastic material.

The center compartment 62 is deeper than either the left compartment 64 or right compartment 66, providing room for an icebox liner 78, which is also of glass-reinforced resin construction and includes a bottom 79, four upstanding walls 81, 83, 85 and 87, and has an upper rim 89. The liner 78 is preferably fixedly attached within the center compartment 62, but may alternatively be removable therefrom. In the preferred embodiment of the invention, the rim 89 of the icebox liner 78 is adhesively attached to the top section 56, within the access opening to the center compartment 60, by adhesive resin, and the liner 78 is surrounded by a layer 80 of thermal insulating material which may, for example, be a foam material expanded in place.

The upper surface of the top section 56 is inclined upwardly toward the edges of the opening of the center compartment 62, and includes a rear panel 82 which slopes upwardly and forwardly from the central portion of the rear edge of the top section 56, where it joins with the corresponding upper edge of the rear wall 50. The rear panel 82 is spaced rearwardly from the rear wall 81 of the icebox liner 78 far enough to permit installation of instrument indicator housings 84. The housings 84 are preferably sealingly fitted into appropriate holes provided for that purpose in the rear panel 82, to preserve the overall watertight integrity of the utility container 10.

Each of the right and left end walls 52 and 54 extends slopingly upward and outward from the bottom wall 48 and is downwardly concave toward the respective longitudinal frame member 22 or 24. A reinforcing plate 86 is adhesively attached to the inner side of each of the end walls 52 and 54, with a pair of clamp bolts 88 extending from each of the reinforcing plates 86 through the respective end wall. A clamp plate 90, also of fiberglass reinforced resin material, is associated with each side of the utility container 10. A first end 92 of each clamp plate 90 is located adjacent the respective side wall where it joins the bottom wall 48. The clamp bolts 88 extend through the respective clamp plate 90, and a second end 94 of each clamp plate 90 is held tightly against the underside of the respective longitudinal frame member 22 or 24, by a fastener such as a wing nut 96 engaging threads provided on each of the clamp bolts 88 to tighten the clamp plates 90 against the longitudinal frame members. Preferably, a resilient cushion member 98, for example, a rubber strip, is located between each of the end walls 52 and 54 and the respective longitudinal frame member 22 or 24.

Because of the location of the pylons 34 and the shape of the corner pieces 26, 28, 30, and 32, depressions 100 and 102 are provided in the bottom section 46, to permit the container 10 to fit snugly against the rear side of the front transverse frame member 20, between the longitudinal frame members 22 and 24, as shown in FIGS. 1, 2, 5, and 6. Thus the utility container 10 is located mainly below the original level of the trampoline, and the top of the utility container remains available as a place to sit or stand, instead of being cluttered by articles carried aboard the boat.

A drain tube 103 extends downwardly from the icebox liner 78 and the bottom wall 48 of the bottom section 46 of the container 10. The drain tube 103 is equipped with a closable valve 104 to permit the icebox liner to be continuously drained, if desired, or to retain liquid as it melts from ice contained within the icebox liner 78.

An upstanding edge 106 surrounds each opening in the top section 56 through which access is available to each of the center, left, and right compartments 62, 64 and 66, respectively. A seal member, for example, a resilient rubber strip 108, is adhesively attached to the bottom side of each of the covers 68, 70, and 72 to sealingly fit against the edge 106 when the respective cover 68, 70, or 72 is closed.

Ordinarily, a front edge bolt rope (not shown) attached to the front edge of the respective left and right portions 40 and 42 of the trampoline 38 is held within a C-shaped trackway defined by the forward transverse frame member 20, to hold the respective left and right portions 40 and 42 of the trampoline 38 forward against the tension exerted rearwardly on the trampoline 38 by the lacing 44. With the container 10 in place on the catamaran 12, it is necessary to provide an alternative forwardly located member to support the front of the trampoline 38. Accordingly, a crossbar 110 extends transversely along the rear of the container 10, with respective left and right ends of the crossbar 110 being located within the C-shaped trackways provided in the longitudinal frame members 22 and 24 to hold the lateral edges of the trampoline sections 40 and 42. The crossbar 110 may, for example, be a piece of 1-inch diameter heavy-wall aluminum pipe. Respective left and right diagonal braces 112 and 114 extend diagonally inward and forward from the longitudinal frame members 22 and 24, being welded to points of attachment along the crossbar 110. Stop screws 116 are located in holes provided in each of the longitudinal frame members 22 and 24 to prevent rearward motion of the crossbar 110 and the diagonal braces 112 and 114 under tension exerted by the trampoline portions 40 and 42.

To support the downward stress applied against the crossbar 110, a downwardly extending centrally located leg 118 is fixedly attached to the underside of the crossbar 110 and extends downward a distance of, for example, 8 inches. A truss 120, which may be a metal rod, extends transversely of the catamaran beneath the crossbar 110, resting in a notch 122 defined in the lower end of the downwardly-extending leg 118. Each end of the truss 120 is threaded and extends through a bore provided in a hook 122, which may be, for example, of cast aluminum. The hooks 122 fit around the bottom and outer sides of the respective longitudinal frame members 22 and 24. A self-locking nut 124 is used to tension the truss 120 inwardly against the longitudinal frame members 22 and 24, thus exerting an upward force through the downwardly-extending leg 118 against the bottom of th crossbar 110. The left and right portions 40 and 42, respectively, of the trampoline 38 are wrapped around the crossbar 110 and extend rearwardly toward the rear transverse frame member 18, being held under tension by additional lashings extending through grommets provided in the trampoline left and right sections 40 and 42.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A utility container for mounting on a catamaran boat having a pair of parallel hulls, a respective longitudinal frame member located above and associated with each of said hulls, and a transverse frame member extending between said longitudinal frame members, the utility container comprising:

(a) a bottom section, having a length and a width and including a generally horizontally disposed bottom wall, a pair of opposite side walls, a front wall, and a rear wall, said side, front, and rear walls being connected with said bottom wall;

(b) attachment means associated with each of said side walls, for removably fastening said utility container to said longitudinal frame members of said catamaran boat in a position rearwardly adjacent said transverse frame member;

(c) a top section fixedly connected with said bottom section, said top section including means for defining a plurality of access openings therethrough and including an instrument display area located rearwardly adjacent one of said plurality of access openings; and (d) respective cover means hingedly attached to said top section for closing each of said access openings.

2. The container of claim 1, including a pair of generally vertical divider members extending longitudinally within said container and defining a center compartment and a pair of outboard compartments within said container.

3. The container of claim 2, including a liner located in said center compartment and a layer of thermal insulating material located between said vertical divider members outside said liner.

4. The container of claim 1 wherein said front wall extends slopingly forward and upward from said bottom wall and includes an upwardly convexly arcuate upper margin.

5. The container of claim 1 wherein said top section includes a generally horizontal raised central portion and a downwardly and rearwardly sloped rear panel adjacent said generally horizontal raised central portion, said central portion defining one of said openings, and said container including a liner communicating with said one of said openings and having respective bottom, front, side, and rear liner walls located within said container and spaced a predetermined distance apart from said rear and front walls of said container.

6. A utility container for mounting on a catamaran boat having a pair of parallel hulls, a respective longitudinal frame member located above and associated with each of said hulls, a forward transverse frame member extending between said longitudinal frame members, a pylon located on each of said hulls adjacent the intersection of said forward transverse frame member and a respective one of said longitudinal frame members, and a corner member interconnecting a respective longitudinal frame member with said forward transverse frame member and said pylon, the utility container comprising:

(a) a bottom section, having a length and a width and including a generally horizontally disposed bottom wall, a pair of opposite side walls, a front wall, and a rear wall, said side, front, and rear walls being connected with said bottom wall and said bottom section further having means defining a depression in said bottom portion for fitting over said pylon and corner member with said container adjacent said forward transverse frame member;

(b) attachment means associated with each of said side walls, for removably fastening said utility container to said longitudinal frame members of said catamaran boat in a position rearwardly adjacent said transverse frame member;

(c) a top section fixedly connected with said bottom section, said top section including means for defining a plurality of access openings therethrough; and (d) respective cover means hingedly attached to said top section for closing each of said access openings.

7. A utility container for mounting on a catamaran boat having a pair of parallel hulls, a respective longitudinal frame member located above and associated with each of said hulls, and a transverse frame member extending between said longitudinal frame members, the utility container comprising:

(a) a bottom section, having a length and a width and including a generally horizontally disposed bottom wall, a pair of opposite side walls, a front wall, and a rear wall, said side, front, and rear walls being connected with said bottom wall;

(b) attachment means associated with each of said side walls, for removably fastening said utility container to said longitudinal frame members of said catamaran boat in a position rearwardly adjacent said transverse frame member, said attachment means including at least one clamp bolt attached to and extending outwardly and generally downwardly from each of said side walls, and a clamp plate extending generally along each of said side walls, each said clamp plate defining a hole therethrough for receiving each respective clamp bolt, and adjustable means for tightening said clamp plate against a respective one of said longitudinal frame members;

(c) a top section fixedly connected with said bottom section, said top section including means for defining a plurality of access openings therethrough; and (d) respective cover means hingedly attached to said top section for closing each of said access openings.

8. In a catamaran sailboat including a pair of parallel longitudinal hulls, a longitudinal frame member located above and associated with each of said hulls, a forward transverse frame member extending between said longitudinal frame members, and a utility container extending laterally between said longitudinal frame members, rearwardly adjacent said forward transverse frame member, the improvement comprising:

(a) in said utility container, a bottom section having a length and a width and including a generally horizontally disposed bottom wall, a pair of opposite side walls, a front wall, and a rear wall, said side, front, and rear walls being connected with said bottom wall;

(b) attachment means associated with each of said side walls, for removably fastening said utility container to said longitudinal frame members rearwardly adjacent said transverse frame member;

(c) a top section fixedly connected with said bottom section, said top section including means for defining a plurality of access openings;

(d) removable cover means for closing said at least one opening;

(e) a transversely extending crossbar member located rearwardly adjacent said utility container and fixedly attached to said longitudinal frame members; and (f) a trampoline, a portion of said trampoline extending around said crossbar member and being supported thereby.

9. The catamaran of claim 8 wherein said crossbar member further includes a downwardly extending centrally located leg member fixedly attached thereto, and a transversely extending adjustable tension member supported by said longitudinal frame members and extending supportingly beneath said leg member.

* * * * *